US008881844B2

(12) United States Patent
Farley et al.

(10) Patent No.: US 8,881,844 B2
(45) **Date of Patent: *Nov. 11, 2014**

(54) DIRECTIONAL DRILLING CONTROL USING PERIODIC PERTURBATION OF THE DRILL BIT

(75) Inventors: Steven Reid Farley, Magnolia, TX (US); Michael Louis Larronde, Houston, TX (US); Roger P. Bartel, Spring, TX (US); Charles Lee Mauldin, Spring, TX (US); Robert Anthony Aiello, Spring, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 382 days.

This patent is subject to a terminal disclaimer.

(21) Appl. No.: 13/232,805

(22) Filed: Sep. 14, 2011

(65) Prior Publication Data

US 2012/0000709 A1 Jan. 5, 2012

Related U.S. Application Data

(60) Continuation of application No. 12/986,823, filed on Jan. 7, 2011, which is a division of application No. 12/344,873, filed on Dec. 29, 2008, now abandoned, and a continuation-in-part of application No. 12/824,965, filed on Jun. 28, 2010, which is a continuation of application No. 11/848,328, filed on Aug. 31, 2007, now Pat. No. 7,766,098.

(51) Int. Cl.
*E21B 7/06* (2006.01)
*E21B 44/00* (2006.01)

(52) U.S. Cl.
CPC ..... *E21B 7/067* (2013.01); *E21B 44/005* (2013.01); *E21B 7/068* (2013.01)
USPC ..... 175/61; 175/74; 175/293; 175/83

(58) Field of Classification Search
CPC ..... E21B 4/06; E21B 6/08; E21B 7/067; E21B 7/068; E21B 7/04; E21B 7/06
USPC ..... 175/61, 74, 293, 83
See application file for complete search history.

(56) References Cited

U.S. PATENT DOCUMENTS 701,391 A 6/1902 Pruszkowski
2,360,318 A 7/1966 Neilson et al.

(Continued)

FOREIGN PATENT DOCUMENTS

AU 2009233655 A1 7/2010
CA 2201058 9/1997

(Continued)

OTHER PUBLICATIONS

Office Action received Mar. 2011 for corresponding Russian patent application No. 2009145914.

(Continued)

*Primary Examiner* — Cathleen Hutchins
(74) *Attorney, Agent, or Firm* — Wong, Cabello, Lutsch, Rutherford & Brucculeri LLP

(57) ABSTRACT

Disclosed herein is a system for steering the direction of a borehole advanced by cutting action of a rotary drill bit by periodically varying action of a drill bit while continuously rotating a drill string to which the drill bit is operationally attached. The steering system can include a bit perturbation device cooperating with a bent housing subsection and operationally connected to the drill string and to the drill bit. Drill bit action can be varied by periodically varying the rotation speed and/or rate of penetration of the drill bit. Periodic drill bit action results in preferential cutting of material from a predetermined arc of the borehole wall which, in turn, results in borehole deviation. Action of the drill bit can be varied independently of the rotation rate of the drill string.

20 Claims, 4 Drawing Sheets

(56) References Cited

U.S. PATENT DOCUMENTS

| | | | |
|---|---|---|---|
| 3,260,318 | A | 7/1966 | Neilson et al. |
| 3,360,057 | A | 12/1967 | Anderson |
| 3,481,420 | A | 12/1969 | Roll |
| 3,713,500 | A | 1/1973 | Russell |
| 3,802,575 | A | 4/1974 | Ingram et al. |
| 3,841,420 | A | 10/1974 | Russell |
| 3,958,217 | A | 5/1976 | Spinnler |
| 4,401,134 | A | 8/1983 | Dailey |
| 4,465,147 | A | 8/1984 | Feenstra et al. |
| 4,480,066 | A | 10/1984 | Davis et al. |
| 4,485,879 | A | 12/1984 | Kamp et al. |
| 4,492,276 | A | 1/1985 | Kamp |
| 4,577,701 | A | 3/1986 | Dellinger et al. |
| 4,637,479 | A | 1/1987 | Leising |
| 4,667,751 | A | 5/1987 | Geczy et al. |
| 4,742,498 | A | 5/1988 | Barron |
| 4,763,258 | A | 8/1988 | Engelder |
| 4,844,180 | A | 7/1989 | Zijsling |
| 4,862,568 | A | 9/1989 | Wankmuller et al. |
| 4,869,100 | A | 9/1989 | Birdwell |
| 5,133,418 | A | 7/1992 | Gibson et al. |
| 5,738,178 | A | 4/1998 | Williams et al. |
| 6,053,261 | A | 4/2000 | Walter |
| 6,092,610 | A | 7/2000 | Kosmala et al. |
| 6,129,160 | A | 10/2000 | Williams |
| 6,233,524 | B1 | 5/2001 | Harrell et al. |
| 6,571,888 | B2 | 6/2003 | Comeau et al. |
| 7,086,486 | B2 | 8/2006 | Ravensbergen et al. |
| 7,270,198 | B2 | 9/2007 | Camp |
| 7,766,098 | B2 | 8/2010 | Farley |
| 2002/0066598 | A1 | 6/2002 | Rozendaal et al. |
| 2002/0084109 | A1 | 7/2002 | Runquist et al. |
| 2002/0166701 | A1 | 11/2002 | Comeau et al. |
| 2003/0116355 | A1 | 6/2003 | Bar-Cohen et al. |
| 2003/0146022 | A1 | 8/2003 | Krueger |
| 2004/0236553 | A1 | 11/2004 | Chen et al. |
| 2005/0194183 | A1 | 9/2005 | Gleitman et al. |
| 2005/0236189 | A1 | 10/2005 | Rankin, III |
| 2008/0093124 | A1 | 4/2008 | Giroux et al. |
| 2010/0263933 | A1 | 10/2010 | Farley |
| 2011/0108327 | A1 | 5/2011 | Farley et al. |

FOREIGN PATENT DOCUMENTS

| | | | |
|---|---|---|---|
| EP | 0171259 | A1 | 12/1986 |
| EP | 0333484 | | 9/1989 |
| EP | 0333484 | A2 | 9/1989 |
| EP | 0467335 | A1 | 1/1992 |
| EP | 0624706 | | 11/1994 |
| EP | 0624706 | A2 | 11/1994 |
| EP | 0798443 | | 10/1997 |
| EP | 0798443 | A2 | 10/1997 |
| EP | 1024245 | A2 | 2/2000 |
| EP | 1258593 | A3 | 11/2002 |
| EP | 1756390 | | 2/2007 |
| EP | 2202382 | A2 | 6/2010 |
| GB | 2352743 | A | 7/2001 |
| GB | 2435060 | A | 8/2007 |
| GB | 2440024 | A | 1/2008 |
| RU | 2114273 | C1 | 6/1998 |
| RU | 2233374 | C1 | 7/2004 |
| WO | 0166900 | | 9/2001 |
| WO | 0166900 | A2 | 9/2001 |
| WO | 2005113928 | | 12/2005 |
| WO | 2005113928 | A2 | 12/2005 |
| WO | 2009032367 | | 3/2009 |
| WO | 2009032367 | A2 | 3/2009 |

OTHER PUBLICATIONS

Non-Final Office Action received for corresponding U.S. Appl. No. 12/344,873 mail date Sep. 7, 2010.

Non-Final Office Action received for corresponding U.S. Appl. No. 12/986,823 mail date Apr. 14, 2011.

International Search Report and Written Opinion from PCT/US2008/064642, dated Sep. 3, 2008 received in corresponding U.S. Appl. No. 11/848,328.

Non-Final Office Action received for related U.S. Appl. No. 11/848,328 mail date Jul. 31, 2009.

Final Office Action received for related U.S. Appl. No. 11/848,328 mail date Jan. 27, 2010.

Non-Final Office Action received for related U.S. Appl. No. 12/824,965 mail date Jul. 7, 2011.

Examiner's First Report received for corresponding Australian patent application No. 2009233655 mail date Jan. 6, 2011.

Office Action received Mar. 7, 2011 for corresponding Russian patent application No. 2010107703.

International Search Report from UK patent application No. GB0909673.6 dated Sep. 18, 2009.

Notice of Allowance received for related U.S. Appl. No. 11/848,328 mail date Apr. 7, 2010.

Non-Final Office Action received for related U.S. Appl. No. 12/986,823 mail date Apr. 14, 2011.

Office Action received Mar. 7, 2011 for related Russian patent application No. 2010107703.

Non-Final Office Action received for related U.S. Appl. No. 12/480,104 mail date Jun. 8, 2011.

European Search Report dated Oct. 13, 2011 for corresponding European patent application No. 09175318.6.

Final Office Action received in related U.S. Appl. No. 12/480,104, mail date Oct. 27, 2011.

European Search Report received in corresponding European patent application No. EP 09 17 5318.6, dated Oct. 4, 2011.

Non Final Office Action received in related U.S. Appl. No. 13/651,545 mail date Jan. 24, 2013.

First Office Action mail date Jul. 13, 2012 received for corresponding Mexican patent application No. 2009013849.

Examination Report received in corresponding European Application No. 09175318.6, dated Dec. 12, 2013, 4 pages.

Examination Report received in European Application No. 08756172.6, dated Dec. 12, 2013, 3 pages.

DIRECTIONAL DRILLING CONTROL USING PERIODIC PERTURBATION OF THE DRILL BIT

This application is a continuation of U.S. patent application Ser. No. 12/986,823, filed Jan. 7, 2011, which is a divisional of U.S. patent application Ser. No. 12/344,873, filed Dec. 29, 2008, now abandoned, both entitled "Directional Drilling Control Using Periodic Perturbation of the Drill Bit." This application is also a continuation-in-part of U.S. patent application Ser. No. 12/824,965, filed Jun. 28, 2010, which is a continuation of U.S. patent application Ser. No. 11/848,328, filed Aug. 31, 2007, now issued as U.S. Pat. No. 7,766,098, both entitled "Directional Drilling Control Using Modulated Bit Rotation." Each of these applications is hereby incorporated by reference in its entirety.

FIELD OF THE INVENTION

This invention is related to the directional drilling of a well borehole. More particularly, the invention is related to steering the direction of a borehole advanced by a rotary drill bit by periodically perturbing the action of the drill bit during a revolution of the drill string to which the drill bit is operationally connected thereby allowing borehole trajectory to be controlled during continuous drill string rotation.

BACKGROUND

The complex trajectories and multi-target oil wells require precision placement of well borehole path and the flexibility to continually maintain path control. It is preferred to control or "steer" the direction or path of the borehole during the drilling operation. It is further preferred to control the path rapidly during the drilling operation at any depth and target as the borehole is advanced by the drilling operation.

Directional drilling is complicated by the necessity to operate a drill bit steering device within harsh borehole conditions. The steering device is typically disposed near the drill bit, which terminates lower or "downhole" end of a drill string. In order to obtain the desired real time directional control, it is preferred to operate the steering device remotely from the surface of the earth. Furthermore, the steering device must be operated to maintain the desired path and direction while being deployed at possibly a great depth within the borehole and while maintaining practical drilling speeds. Finally, the steering device must reliably operate under exceptional heat, pressure, and vibration conditions that can be encountered during the drilling operation.

Many types of directional steering devices, comprising a motor disposed in a housing with an axis displaced from the axis of the drill string, are known in the prior art. The motor can be a variety of types including electric, or hydraulic. Hydraulic turbine motors operated by circulating drilling fluid are commonly known as a "mud" motors. A rotary bit is attached to a shaft of the motor, and is rotated by the action of the motor. The axially offset motor housing, commonly referred to as a bent subsection or "bent sub," provides axial displacement that can be used to change the trajectory of the borehole. By rotating the drill bit with the motor and simultaneously rotating the drill bit with the drill string, the trajectory or path of the advancing borehole is parallel to the axis of the drill string. By rotating the drill bit with the motor only, the trajectory of the borehole is deviated from the axis of the non-rotating drill string. By alternating these two methodologies of drill bit rotation, the path of the borehole can be controlled. A more detailed description of directional drilling using the bent sub concept is presented in U.S. Pat. Nos. 3,260,318, and 3,841,420, which are hereby incorporated into this disclosure by reference.

The prior art contains methods and apparatus for adjusting the angle or "bend" of a bent sub housing thereby directing the angle of borehole deviation as a function of this angle. The prior art also contains apparatus and methods for dealing with unwanted torques that result from steering operations including clutches that control non periodic bit rotation in order to position the bit azimuthally as needed within the walls of the borehole. Prior art steering systems using variations of the bent sub concept typically rely upon non periodic continuous pushing or pointing forces and the associated equipment which directs the hole path by exerting large pressures on the bit perpendicular to the borehole path while rotating the drill string.

SUMMARY OF THE INVENTION

This invention comprises apparatus and methods for steering the direction of a borehole advanced by cutting action of a rotary drill bit terminating a lower or "downhole" end of a drill string. The cutting action or "action" of the bit is periodically perturbed during a rotation of a bent housing subsection or "bent sub" disposed in the drill string and attached to the drill bit thereby cutting a disproportionately larger amount of material from an azimuthal arc of wall of the borehole, which will result in an azimuthal deviation in borehole direction while continuously rotating the drill string. The perturbation can comprise any periodic variation in the rate of penetration (ROP) of the drill bit.

The steering device, which is disposed at the downhole end of a drill string, comprises a drill bit perturbation device disposed above the bent sub. This bit perturbation device can comprise rotary acting hammers, vibrators and the like that periodically vary the ROP of the drill bit. The drill bit is preferably operationally connected to the bit perturbation device by a shaft. The drill bit can be rotated by both the bit perturbation device and by the rotary action of the drill string. Alternately, the drill bit can be rotated only by the bit perturbation device or only by the rotary action of the drill string.

As stated above, the steering system is designed so that the drill bit disproportionally cuts material along the wall of the borehole in a predetermined azimuthal arc to direct the advancement of the borehole in a desired trajectory. In the disclosed embodiments of the invention, the action of the bit disposed below the bent sub is periodically varied in this predetermined arc cutting a disproportionally small amount of material from the borehole wall. As a result, the bit moves to the opposite side of the borehole and cuts a disproportionately larger amount of material from the borehole wall. The borehole then tends to deviate and advance in the azimuthal direction in which the disproportional large amount of borehole wall material has been removed. This disproportional removal of material is accomplished while continuously rotating the drill string.

The removal of material from the wall of the borehole, thus the steering of the borehole trajectory, is accomplished by periodically varying the action of the drill bit during a rotation of the drill string, with the drill bit cooperating with the bent sub. If the bit perturbation device comprises a motor, the steering system can use two elements for rotating the drill bit. The first element used to rotate the drill bit is the rotating drill string. The second element used to rotate the drill bit is the motor disposed above the bent sub and operationally connected to the drill bit. The final drill bit rotational speed is the sum of the rotational speeds provided by the drill string and the motor.

It is preferred that both the drill string and the motor rotate simultaneously. If a constant borehole trajectory is desired, the ROP of the bit is held constant throughout a drill string revolution. The procession of the bit rotation around the borehole removes essentially the same amount of material azimuthally around the borehole wall. If a deviated borehole trajectory is desired, the ROP of the drill bit is periodically varied as it passes through a predetermined azimuthal sector of the borehole wall. This periodic variation of the action of the drill bit can be accomplished by any periodic variation of the ROP of the drill bit. These methodologies remove relatively smaller amounts from one side of the borehole and remove relatively larger amounts of material on the opposite side of the borehole. The borehole is thus deviated in the direction of disproportionately large amount of material removal. These methodologies will be discussed in detail in subsequent sections of this disclosure.

BRIEF DESCRIPTION OF THE DRAWINGS

The manner in which the above recited features and advantages, briefly summarized above, are obtained can be understood in detail by reference to the embodiments illustrated in the appended drawings.

DETAILED DESCRIPTION OF THE PREFERRED EMBODIMENTS

Disclosed herein are devices and methods for steering the direction of a borehole advanced by cutting action of a rotary drill bit.

Directional drilling is obtained by periodically perturbing the action of the drill bit. For purposes of this disclosure "periodic variation" is defined as varying the drill bit rotation speed and/or rate of penetration (ROP) in a plurality of 360-degree drill string rotations or "cycles" at the same azimuthal arc in the plurality of rotations.

Hardware

Figure 1:
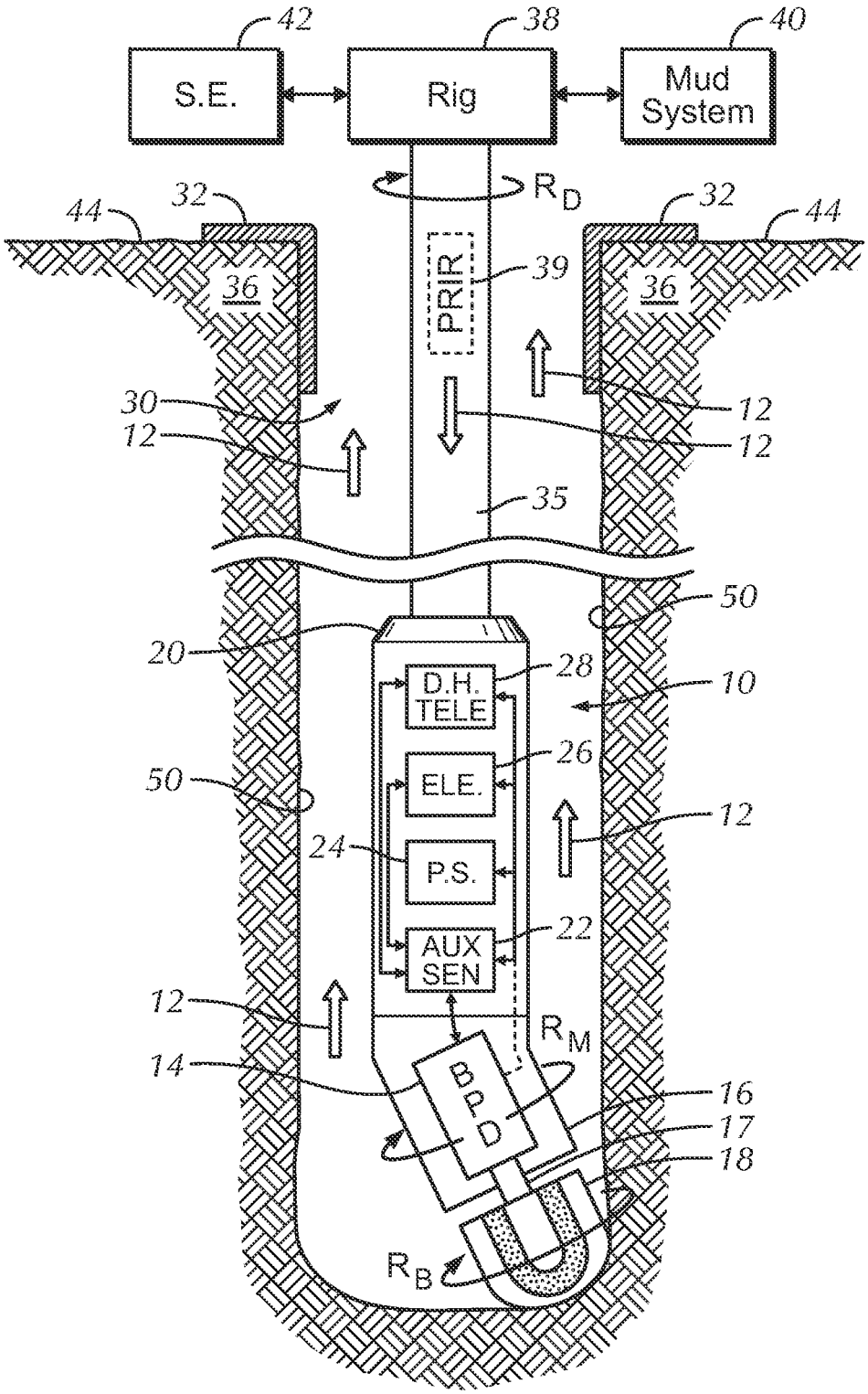
FIG. 1 illustrates borehole assembly comprising a bent sub disposed in a well borehole by a drill string operationally attached to a rotary drilling rig.

Attention is directed to FIG. 1, which illustrates a borehole assembly (BHA) 10 suspended in a borehole 30 defined by a wall 50 and penetrating earth formation 36. The upper end of the BHA 10 is operationally connected to a lower end of a drill pipe 35 by means of a suitable connector 20. The upper end of the drill pipe 35 is operationally connected to a rotary drilling rig, which is well known in the art and represented conceptually at 38. Surface casing 32 extends from the borehole 30 to the surface 44 of the earth. Elements of the steering apparatus are disposed within a bent sub 16 of the BHA 10. A rotary drill bit 18 is operationally connected to the bent sub 16 by a shaft 17. Any rotation of the drill bit 18 is illustrated conceptually by the arrow $R_B$.

Again referring to FIG. 1, the BHA 10 also comprises an auxiliary sensor section 22, a power supply section 24, an electronics section 26, and a downhole telemetry section 28. The auxiliary sensor section 22 comprises directional sensors such as magnetometers and inclinometers that can be used to indicate the orientation of the BHA 10 within the borehole 30. This information, in turn, is used in defining the borehole trajectory path for the steering methodology. The auxiliary sensor section 22 can also comprise other sensors used in Measurement-While-Drilling (MWD) and Logging-While-Drilling (LWD) operations including, but not limited to, sensors responsive to gamma radiation, neutron radiation and electromagnetic fields. The electronics section 26 comprises electronic circuitry to operate and control other elements within the BHA 10. The electronics section 26 preferably comprise downhole memory (not shown) for storing directional drilling parameters, measurements made by the sensor section, and directional drilling operating systems. The electronic section 26 also preferably comprises a downhole processor to control elements comprising the BHA 10 and to process various measurement and telemetry data. Elements within the BHA 10 are in communication with the surface 44 of the earth via a downhole telemetry section 28. The downhole telemetry section 28 receives and transmits data to an uphole telemetry section (not shown) preferably disposed within surface equipment 42. Various types of borehole telemetry systems are applicable including mud pulse systems, mud siren systems, electromagnetic systems and acoustic systems. A power supply section 24 supplies electrical power necessary to operate the other elements within the BHA 10. The power is typically supplied by batteries.

Once again referring to FIG. 1, drilling fluid or drilling "mud" is circulated from the surface 44 downward through the drill string comprising the drill pipe 35 and BHA 10, exits through the drill bit 18, and returns to the surface via the borehole-drill string annulus. Circulation is illustrated conceptually by the arrows 12. The drilling fluid system is well known in the art and is represented conceptually at 40.

As mentioned previously, directional steering is obtained using a drill bit perturbation device. Three embodiments of the bit perturbation device are disclosed. It should be understood that the disclosures are general, and can be modified to obtain similar steering results.

Figure 2:
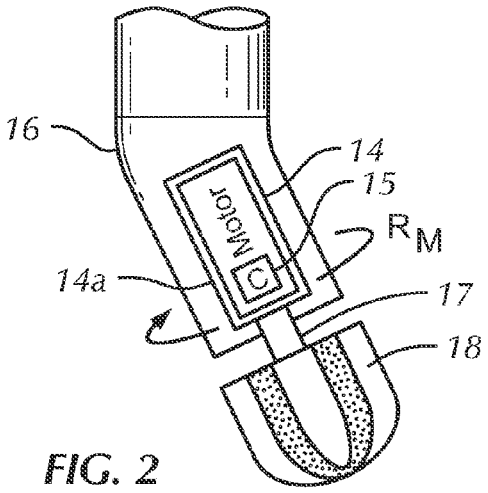
FIG. 2 illustrates a bit perturbation device comprising a mud motor 14*a* and a cooperating brake/clutch assembly.

FIG. 2 illustrates a bit perturbation device 14 comprising a mud motor 14*a* and a cooperating brake/clutch assembly 15. The mud motor 14*a* is disposed within the bent sub 16. The clutch/brake assembly 15 is shown disposed within the motor 14*a* and cooperates with the motor to periodically vary the rotational speed of the drill bit 18 operationally attached to the motor 14 by the shaft 17. The motor 14 can be Moineau or turbine type motor. The downward flow of drilling fluid imparts rotation to the drill bit 18 through the shaft 17, as indicated by the arrow $R_M$ shown in FIG. 2.

Although the bit perturbation device shown in FIG. 2 is disposed within the motor 14*a*, it should be understood that the clutch/brake assembly 15 can be disposed at other positions within the motor-drill bit drive train. An example of a clutch/brake assembly is disclosed in U.S. Pat. No. 3,841,420, which is entered into this disclosure by reference. Other embodiments of clutch/brake assemblies are disclosed in U.S. Pat. Nos. 5,738,178 and 3,713,500. The clutch/brake assembly 15 can comprise a plain brake, a hydraulic multidisc clutch, or a hysteresis clutch located within the motor-bit drive train or within the drill string 35 above the motor 14. The assembly 15 cooperates with the downhole processor of the electronic section 26 to activate periodically during a rotation of the BHA 10. This results in a periodic variation in rotational speed $R_M$ of the drill bit thereby preferentially removing material from the borehole wall in a predetermined azimuthal arc. This, in turn, results in directional control as will be detailed in a subsequent section of this disclosure. A more complex embodiment of the clutch/brake assembly 15 can comprise two or more gear assemblies that can be selected to further periodically vary the rotational speed of the drill bit 18.

Figure 3:
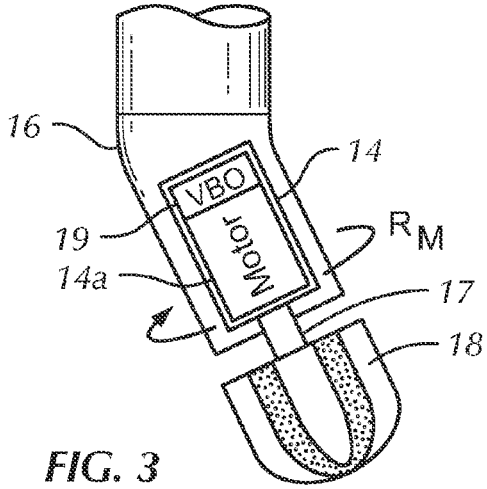
FIG. 3 illustrates a bit perturbation device comprising a mud motor and a drilling fluid variable bypass orifice.

FIG. 3 illustrates a bit perturbation device 14 comprising a mud motor 14*a* and a drilling fluid variable bypass orifice 19 that controls the flow of drilling fluid through the mud motor. The concept of a variable bypass orifice has been used in prior art mud pulse telemetry systems such as the type disclosed in U.S. Pat. No. 4,869,100. Bypass orifices and valves cooperating with turbine motors are disclosed in U.S. Pat. Nos. 3,802,575 and 7,086,486. U.S. Pat. Nos. 3,958,217, 4,742,498 and 4,401,134 disclose valves that spin and rotate with a ported rotor. These references are herein entered into this disclosure by reference. Minimal pressure fluctuations are associated with flow changes thereby requiring less horsepower from surface pumps. Any periodic variation in fluid flow through the bypass orifice results in a corresponding periodic variation in the rotational speed $R_M$ of the drill bit 18. Although illustrated as being immediately above the mud motor 14*a*, it should be understood that the variable bypass orifice 19 can be disposed at other positions in the drill string above the mud motor or alternately within the mud motor assembly. The variable bypass orifice cooperates with the downhole processor of the electronic section 26 to activate periodically during a rotation of the BHA 10 and the bent sub 16. This results in the desired periodic variation in rotational speed $R_M$ of the drill bit thereby preferentially removing material from the borehole wall in a predetermined azimuthal arc thereby deviating the borehole path in a predetermined direction.

Figure 4:
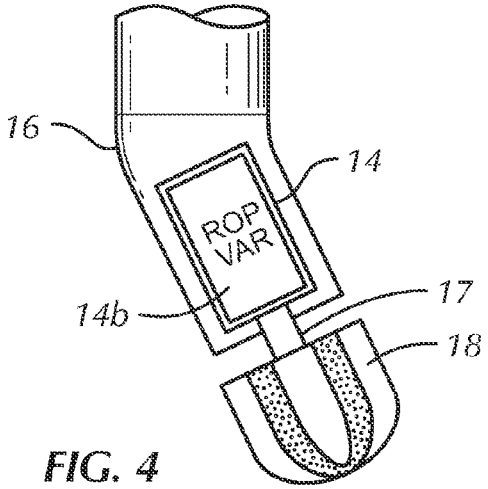
FIG. 4 illustrates a bit perturbation device comprising an assembly that periodically varies the rate of penetration of the drill bit.

FIG. 4 illustrates a bit perturbation device 14 comprising an assembly 14*b* that periodically varies the rate of penetration (ROP) rather than the rotational speed of the drill bit 18. These elements impart axial and azimuthal force components at the drill bit face and can be, but are not limited to, hammers and vibrators. The bit perturbation device 14*b* can also comprise an electric or a mud motor. Vibrators and hammers can be engineered by fluid driven masses that rise and fall under a periodic cue supplied by the downhole processor in the electronics section 26 thereby improving weight transfer to the drill bit 18. Alternately, a rotary mass can be used, under the periodic cue of the downhole processor, to periodically vibrate the BHA 10 thereby improving weight transfer to the face of the drill bit 18. These transfers, in turn, result in an increase in ROP. Although hammers and vibrators impart a rather large periodic axial force along the bent sub, an azimuthal component of this force preferentially removes material from the borehole wall in a predetermined azimuthal arc thereby deviating the borehole path in a predetermined direction. U.S. Pat. No. 701,391 discloses an example of a device used to vary ROP, and is hereby incorporated into this disclosure by reference. ROP variation is obtained by a reciprocating axial motion along the axis of the drill induced by changing drilling fluid flow rate. U.S. Pat. No. 6,053,261 discloses apparatus and methods that are similar in concept to those disclosed in U.S. Pat. No. 701,391.

Basic Operating Principles

The BHA 10 shown in FIG. 1, when rotated at a constant rotation speed or operating at a non-periodic ROP within the borehole 30, sweeps a circular path drilling a borehole slightly larger than the diameter of the drill bit 18. This larger diameter, defined by the borehole wall 50, is due to the angle defined by the axis of the drill pipe 35 and the axis of the bent sub housing 16.

Periodic Variation of Bit Rotation

Attention is directed first to the embodiments that create periodic variation of the rotational speed of the drill bit. As discussed previously, two components of drill bit rotation can be present. The first component results from the action of the drilling rig 38 that rotates the entire drill string at a rotation rate of $R_D$. The second component of rotation results from the action of the motor 10 that rotates the bit at a rate $R_M$. The rotation speed of the drill bit, $R_B$, is the sum of these two components. Stated mathematically, the bit rotation speed $R_B$ is $$R_B=R_D+R_M \tag{1}$$

As shown above, the two components $R_D$ and $R_M$ comprising the final drill bit rotation speed $R_B$ are generally considered separable where directional control is required. As a prior art example, if $R_D$ is set to zero, then the motor 14 will continue to turn the drill bit 18 at a rotation speed $R_M$. The drill bit will increase borehole deviation angle at a constant azimuthal angle defined by the position of the non-rotating bent sub 16, with the drill string sliding down the borehole behind the advancing drill bit. Alternately, if a constant trajectory hole is require to be drilled, then the drill string rotation $R_D$ is initiated along with motor rotation $R_M$, the azimuthal angle of the bent sub 16 is no longer constant due to the rotation of the BHA 10, and the drill bit rotating at $R_B=R_M+R_D$ cuts equally into all sides of hole.

In the periodic procession of the drill bit around the wall of the borehole described above, where $R_D$ and $R_M$ are not equal to zero, the drill bit 18 cuts a different azimuthal section of the hole as a function of procession time. It is during this periodic drill bit procession that $R_B$ can be instantaneously and periodically changed during each revolution of the BHA 10 to preferentially cut one side of the hole at a different rate than it cuts the opposite side of the hole. This also results in increasing borehole deviation angle, while still rotating the drill string. There are operational advantages to continue to rotate the drill string, as will be discussed in a subsequent section of this disclosure. The periodic change in $R_B$ per revolution of the drill string can be implemented by varying either $R_D$ or $R_M$, as will be discussed in detail in subsequent sections of this disclosure.

Periodic Variation of ROP

Attention is now directed to the embodiment in which ROP of the drill bit is periodically varied to deviate the direction of the borehole. If a constant trajectory hole is required to be drilled, then the ROP of the drill bit, $P_B$, is held constant during a given revolution of the drill string. If $P_B$ is periodically varied by activating and deactivating the elements of the bit perturbation device, the drill bit 18 cuts a different azimuthal section of the hole as a function of procession time. It is during this periodic drill bit procession that $P_B$ can be instantaneously and periodically changed during each revolution of the BHA 10 to preferentially cut one side of the hole at a different rate than it cuts the opposite side of the hole. This results in increasing borehole deviation angle, while still rotating the drill string.

Borehole Deviation

Figure 5:
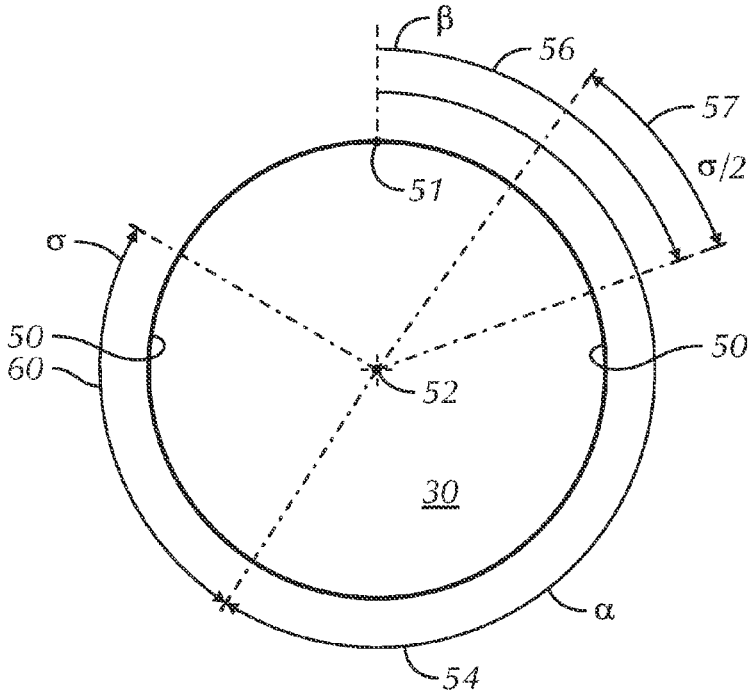
FIG. 5 is a cross section of a cylindrical borehole and is used to define certain parameters used in the steering methodology using both periodic variations in bit rotational speed and bit ROP.

FIG. 5 is a cross section of a cylindrical borehole 30 and is used to define certain parameters used in the steering methodology using both periodic variations in bit rotational speed and bit ROP. The center of the borehole is indicated at 52, and a borehole or "zero" azimuthal reference angle is indicated at 51. For the bit rotational speed embodiments the bit speed $R_B$ is decreased to a value $R_{Bd}$ beginning essentially at variation angle $\alpha$ indicated at 54 and continued through a "dwell" angle of magnitude $\sigma$ indicated at 60. Likewise, for the ROP embodiment, the bit ROP $P_B$ is decreased by deactivating the bit perturbation assembly to a value $P_{Bd}$ beginning essentially at variation angle $\alpha$ indicated at 54 and continued through a dwell angle of magnitude $\sigma$ indicated at 60. The azimuthal position of the variation angle $\alpha$ angle is preferably defined with respect to the reference angle 51. The bit rotation speed, or the bit ROP, are then resumed essentially to $R_B$ and $P_B$, respectively, for the remainder of the 360 degree rotation cycle.

Stated more generally, the bit action rate is varied from a first action rate to a second action rate at the variation angle $\alpha$. The second action rate is maintained through the dwell angle $\sigma$, and the returned to the first action rate. These periodic variations in $R_B$ and $P_B$ decrease cutting power during the dwell angle $\sigma$ (shown at 60) will leave a surplus of borehole wall material essentially at the azimuthal dwell angle $\sigma$. This surplus of material naturally causes the drill bit to move radially to the opposite side of the hole to an azimuthal arc section $\sigma/2$ is indicated at 57 that terminates at an angle $\beta$, where:

$$\beta=\alpha-180°+\sigma/2 \quad (2)$$

and $\beta$ is indicated at 56. Drill bit rotation speed or ROP through the arc $\sigma/2$ to the angle $\beta$ is greater than $R_{Bd}$ or $P_{Bd}$. This results in the removal of a relatively larger amount of borehole wall material in the azimuthal arc 57, thereby deviating the borehole in this azimuthal direction.

Figure 6:
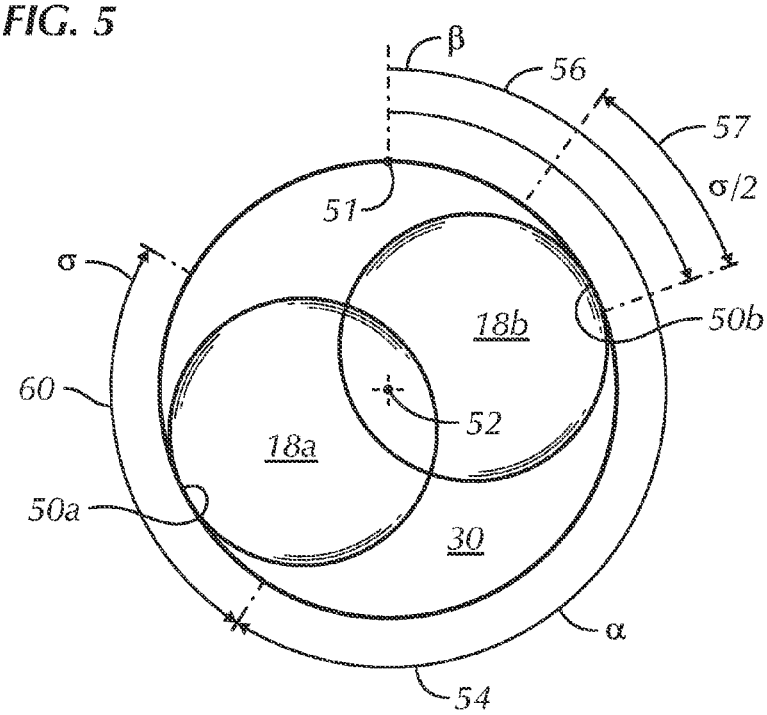
FIG. 6 is a cross section of a borehole in which the rotation speed of the borehole or alternately the ROP of the drill bit has been periodically varied thereby removing a disproportionately small amount of material from one side of the borehole and a disproportionately large amount of material from the opposite side of the borehole.

The previously discussed effects of varying the drill bit rotation speed or drill bit ROP are illustrated conceptually in the borehole cross sectional view of FIG. 6. Drill bit action is perturbed by varying rotation speed from $R_B$ to $R_{Bd}$, or by varying ROP from $P_B$ to $P_{Bd}$, when the bit reaches angle $\alpha$ denoted at 54. The drill bit in this azimuthal position is depicted as 18*a*. Because of the reduction in bit rotation speed or ROP, there is an excess of material along the borehole wall at 50*a*, which corresponds to the dwell angle $\sigma$ shown in FIG. 2. Drill bit rotational speed or ROP are subsequently increased to $R_B$ or $P_B$, respectively, and the bit moves to the opposite side of the borehole 30 to the azimuthal arc 57 terminating at angle $\beta$. The drill bit in this position is as depicted conceptually at 18*b*. A relatively larger amount of borehole wall is removed at 50*b*. By periodically reducing $R_B$ or $P_B$ at the variation angle $\alpha$ as the BHA rotates within the borehole 30, the angle of borehole deviation continues to build in the azimuthal region defined by the arc 57 and the angle $\beta$.

It should be understood that borehole deviation can also be obtained by periodically increasing $R_B$ or $P_B$ thereby removing a relatively larger amount of borehole wall at the angle of periodic rotation increase.

Figure 7A:
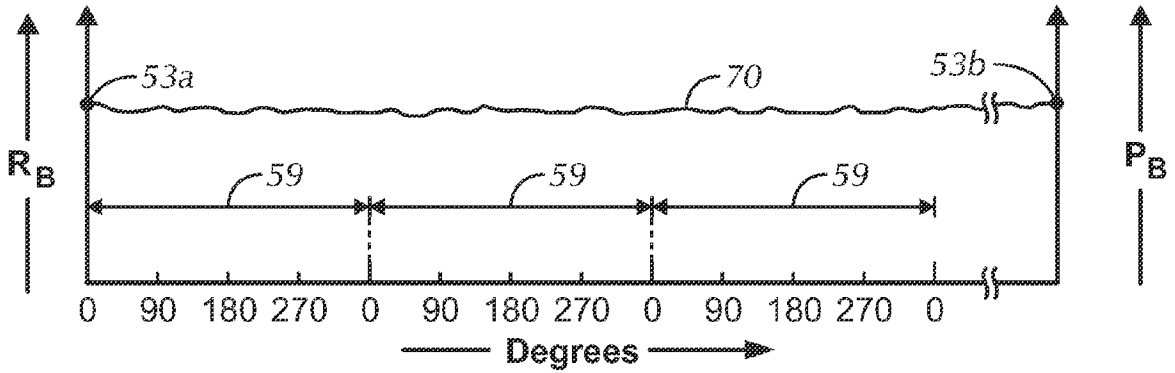
FIG. 7*a* is a plot of a constant rate of rotation of the drill bit or a constant ROP of the drill bit as a function of a plurality of rotational cycles.
Figure 7B:
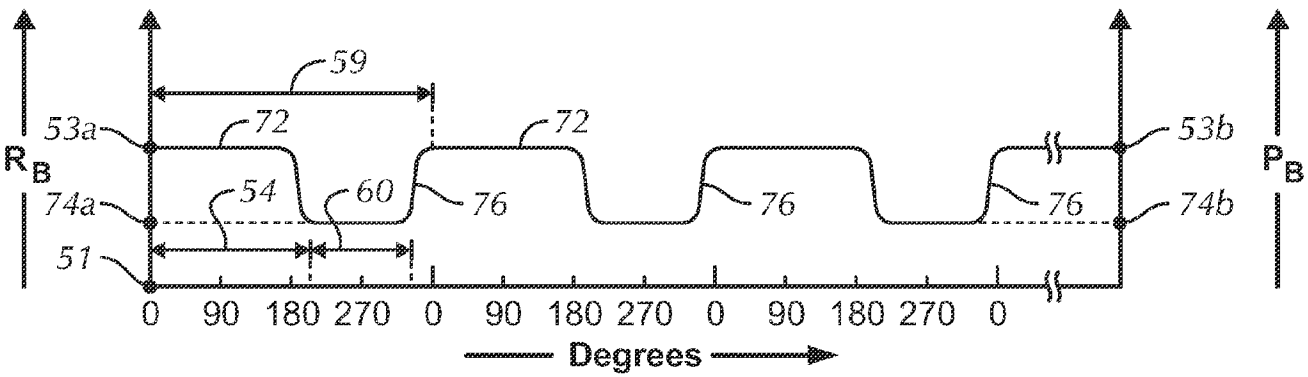
FIG. 7*b* is a plot of a periodic decreasing rotation rate of the drill bit or ROP of the drill bit as a function of a plurality of drill string rotations.

FIGS. 7*a* and 7*b* illustrate graphically results of the methodologies discussed above for bit rotation speed variation and bit ROP variation embodiments. The results are conceptually the same for periodically varying either $R_B$ or $P_B$. Additional illustrations for varying $R_B$ are disclosed in the previously referenced U.S. Pat. No. 7,766,098.

Curve 70 in FIG. 7*a* represents either $R_B$ or $P_B$ (ordinates) as a function of angle (abscissa) through which the BHA 10 is rotated. $R_B$ is represented by the left ordinate and $P_B$ is represented by the right ordinate. Both ordinates are in arbitrary units. Expanding on the examples discusses above and illustrated in FIGS. 5 and 6, the reference or "zero" angle is again denoted at 51. A complete 360 degree BHA rotation cycle is represented at 59, with three such cycles being illustrated. The drill bit is, therefore, rotating at a constant speed $R_B$ shown at 53*a* or penetrating at a constant rate $P_B$ shown at 53*b*.

Curve 72 in FIG. 7*b* represents $R_B$ or $P_B$ as a function of angle through which the BHA 10 is rotated. As in FIG. 7*a*, the reference angle for a drill string rotation cycle is denoted at 51, with three cycles 59 again being depicted. The nominal drill bit rotating at a constant speed $R_B$ 53*a* or penetrating at a constant rate $P_B$ of 53*b*. Further expanding on the examples discussed above and illustrated in FIGS. 5 and 6, either $R_B$ or $P_B$ are periodically decreased, as indicated by excursions 76, to values at 74*a* and 74*b*, respectively. These decreases are initiated at an angle 54 (which corresponds to the speed variation angle $\alpha$) for a dwell angle of 60 (which corresponds to the dwell angle of magnitude $\sigma$). Depending upon the embodiment of the invention, variations in $R_B$ or $P_B$ are repeated periodically during rotation cycles of the drill string. As discussed previously, a decrease in bit rotation or ROP on one side of the borehole causes the drill bit to move to the opposite side of the borehole where bit rotation speed or ROP returns to normal or even increases.

The periodic variation in $R_B$ or $P_B$ can be controlled in real time while drilling using various techniques. Attention is again directed to FIG. 1 as well as FIGS. 7*a* and 7*b*. These real time steering methods typically utilize BHA 10 orientation and position measured with sensors within the auxiliary sensor section 22. A first method comprises the storing of a plurality of bit action rates (as a function of $\alpha$ and $\sigma$) within downhole memory in the electronics section 26. An appropriate sequence is then selected by a signal telemetered from the surface based upon BHA orientation telemetered to the surface along with the known borehole target. The appropriate sequence is typically determined using a surface processor within the surface equipment 42. This method is similar to the "look-up table" concept used in numerous electronics systems. A second method comprises telemetering values of $\alpha$ and $\sigma$ from the surface equipment 42 to the BHA 10 to direct the drilling to the target. The values of $\alpha$ and $\sigma$ are again selected by considering both BHA orientation data (measured with sensors disposed in the auxiliary sensor section 22) telemetered to the surface and the directional drilling target. Telemetered values of bit action rates and dwell angles $\alpha$ and $\sigma$, respectively, are input into an operating program preferably resident in the downhole processor within the electronics section 26. Output supplied by the downhole processor is then used to control and periodically vary the rotation speed of the motor 14 or alternately the ROP of the bit to direct the borehole 30 to a desired formation target. Stated summarily, the action of the drill bit 18 is varied periodically by the bit perturbation device 14 cooperating with the downhole processor, responses of the auxiliary sensors, and preferably with directional information telemetered from the surface of the earth.

It should be understood that other techniques can be used to obtain periodic variations in $R_B$ or $P_B$ including, but not limited to, the use of preprogrammed variation instructions stored in downhole memory of the electronics section 26 and combined with measured BHA orientation data using sensors in the auxiliary sensor section 22. This method requires no real time telemetry communication with the surface equipment 42.

Summary

Disclosed herein are devices and methods for steering the direction of a borehole advanced by cutting action of a rotary drill bit. Steering is accomplished by using a bit perturbation device to periodically vary, during a 360 degree rotation cycle of the drill string, the rotation speed of the drill bit or alternately the ROP of the drill bit. These periodic variations result in the preferential cutting of differing amounts of material from the wall of the borehole within predetermined azimuthal arcs. The borehole deviates in an azimuthal direction in which a relatively larger amount of borehole wall has been cut. In these embodiments, little if any force perpendicular to the axis of the borehole is required. Deviation instead achieved by relying only on the bit perturbation device cooperating with the bent sub and the drill bit to preferentially remove material from the borehole wall while simultaneously maintaining drill string rotation. This allows the borehole path objectives to be achieved using lower strength, less expensive materials that are required in other such methods and associated devices. Furthermore, hydraulics interacting with the borehole wall to push drill string members into the desired direction of deviation need not be employed when using the devices and methods disclosed. Continuous rotation of the drill string, while drilling both straight and deviated borehole, provides superior heat dissipation and more torque at the drill bit.

The above disclosure is to be regarded as illustrative and not restrictive, and should not be construed as limiting the scope of the appended claims.

The invention claimed is:

1. An apparatus for drilling a deviated borehole, the apparatus comprising:

a drill string that rotates continuously during said borehole deviation;

a drill bit cooperating with said drill string;

a bent sub that rotates continuously during said borehole deviation disposed between the drill string and the drill bit; and a bit perturbation device operatively coupled to the drill string, drill bit, and bent sub, the bit perturbation device comprising at least one element that varies rate of penetration of the drill bit during a predetermined azimuthal sector of the borehole wall, thereby deviating the borehole in a direction associated with the predetermined azimuthal sector.

2. The apparatus of claim 1 wherein the bit perturbation device comprises a hammer or vibrator.

3. The apparatus of claim 1 wherein said bit perturbation device comprises a mud motor and a cooperating brake/clutch assembly.

4. The apparatus of claim 1 wherein said bit perturbation device comprises a mud motor and a drilling fluid variable bypass orifice.

5. The apparatus of claim 1 wherein said drill string and said drill bit are rotated simultaneously.

6. A method for deviating a borehole advanced by a rotating drill bit operationally attached to a drill string and a bent sub, said drill string and said bent sub rotating continuously during borehole deviation, the method comprising varying a rate of penetration of the drill bit during a predetermined azimuthal sector of the borehole wall, thereby deviating the borehole in a direction associated with the predetermined azimuthal sector.

7. The method of claim 6 wherein the rate of penetration is varied by use of a mud motor and a cooperating brake/clutch assembly.

8. The method of claim 6 wherein the rate of penetration is varied by use of a mud motor and a drilling fluid variable bypass orifice.

9. The method of claim 6 wherein the rate of penetration is varied by use of a vibrator or hammer.

10. The method of claim 6 wherein varying the rate of penetration further comprises:

periodically varying, at a variation angle, said action of said drill bit from a first action rate to a second action rate;

maintaining said second action rate through a dwell angle; and subsequently resuming said first action rate.

11. The method of claim 10 further comprising telemetering, from the surface of the earth, said variation angle and said dwell angle to a downhole processor cooperating with said bit perturbation device thereby periodically varying said bit action.

12. The method of claim 10 further comprising:

storing said variation angle and said dwell angle in a downhole memory; and transferring said variation angle and said dwell angle to a downhole processor cooperating with said bit perturbation device thereby periodically varying said action of said drill bit.

13. A directional borehole assembly terminating a downhole end of a drill string, said assembly comprising:

a bit perturbation device operatively coupled to the drill string, a drill bit, and a bent sub, said drill string and said bent sub being continuously rotated during borehole deviation, the bit perturbation device comprising at least one element that varies rate of penetration of the drill bit during a predetermined azimuthal sector of the borehole wall, thereby deviating the borehole in a direction associated with the predetermined azimuthal sector;

auxiliary sensors indicating orientation and position of said borehole assembly within said borehole;

a telemetry system for communicating between said borehole assembly and the surface of the earth; and a downhole processor programmed to determine the variation of the rate of penetration of the drill bit by combining responses of the auxiliary sensors with information telemetered from said surface of the earth.

14. The assembly of claim 13 wherein said bit perturbation device further comprises a mud motor and at least one of a cooperating brake/clutch assembly or a drilling fluid variable bypass orifice.

15. The assembly of claim 13 wherein said bit perturbation device further comprises a hammer or vibrator.

16. The assembly of claim 13 wherein said action of said drill bit speed is varied by periodic variation of rotation speed of said drill bit.

17. The assembly of claim 13 wherein said drill string and said drill bit are rotated simultaneously.

18. A borehole assembly for drilling a deviated borehole, the borehole assembly comprising:

a bent sub configured to be continuously rotated during borehole deviation and operatively connected to a drill bit and including a bit perturbation device having an assembly configured to periodically vary a rate of penetration of the drill bit within a single revolution of the drill bit; and an electronics section configured to receive signals from the surface and operate the bit perturbation device so as to preferentially remove a relatively larger amount of material throughout a predetermined azimuthal arc of a wall of the borehole.

19. The borehole assembly of claim 18 wherein the assembly configured to periodically vary a rate of penetration of the drill bit comprises at least one of a vibrator or hammer configured to rise and fall under control of the electronics section.

20. The borehole assembly of claim 18 wherein the assembly configured to periodically vary a rate of penetration of the drill bit comprises a rotary mass that may be actuated by the electronics section to periodically vibrate the borehole assembly, thereby improving weight transfer to the face of the drill bit.

* * * * *